United States Patent [19]

Hara

[11] 4,341,342

[45] Jul. 27, 1982

[54] CENTRIFUGE

[75] Inventor: Minoru Hara, Sakado, Japan

[73] Assignee: Kabushiki Kaisha Kubota Seisakusho, Tokyo, Japan

[21] Appl. No.: 213,143

[22] Filed: Dec. 4, 1980

[51] Int. Cl.[3] ..... B04B 15/02; B04B 15/08; B04B 1/00

[52] U.S. Cl. ..... 233/1 A; 233/11; 233/26

[58] Field of Search ..... 233/26, 27, 28, 1 A, 233/1 B, 23 A, 1 R, 13, 17, 23 R, 11; 211/78, 80

[56] References Cited

U.S. PATENT DOCUMENTS

| | | | |
|---|---|---|---|
| 2,878,992 | 3/1959 | Pickels | 233/26 |
| 2,917,229 | 12/1959 | Benedetto | 233/26 |
| 3,050,239 | 8/1962 | Williams | 233/26 |
| 3,722,791 | 3/1973 | Wright | 233/26 |
| 3,762,635 | 10/1973 | Hankey | 233/23 A |
| 4,221,325 | 9/1980 | Kubota | 233/26 |

*Primary Examiner*—Robert W. Jenkins
*Attorney, Agent, or Firm*—Pollock, Vande Sande & Priddy

[57] ABSTRACT

A centrifuge is provided with a rotor having a plurality of spaced arms each of which has formed integrally therewith stepped portions projecting towards adjacent arms. Tube rack carrying test tubes are each placed between adjacent arms and a centrifugal force applied to the tube rack is received by abutment of engaging portions of the tube rack with the stepped portions of the arms. A cylindrical wind shield is fixed to the rotor in a manner to surround the rotor and the tube racks. The upper open end of the wind shield is almost closed by sectorial plate portions of the arms and one end face of each tube rack.

14 Claims, 14 Drawing Figures

CENTRIFUGE

BACKGROUND OF THE INVENTION

The present invention relates to a centrifuge which is suitable for use in centrifugal separation, sedimentation or the like of small samples.

In the kind of centrifuges employed in the past for this purpose, as disclosed, for example, in Japanese Pat. No. 13839/62, the rotary shaft of a motor is inserted into an inner housing, a tube rack support or what is called a rotor is mounted on the rotary shaft in the inner housing, a plurality of test tubes are placed in the rotor radially of the rotary shaft. By driving the motor at high speed, the test tubes are rotated to apply centrifugal force to the samples in the test tubes for separation and sedimentation. In such a conventional centrifuge, since the test tubes are exposed in the inner housing during the high-speed rotation, the temperature of the test tubes is likely to rise due to air resistance to exert influence on the samples. Furthermore, since the test tubes are subjected to a large air resistance by such high-speed rotation, it is necessary to rotate the test tubes against the large air resistance; accordingly, a large drive power is required of the motor to compensate for what is called a windage loss and the power consumption of the motor naturally increases. In addition, there is a problem of noise which is generated by the test tubes while being rotated at high speed.

To avoid such defects, it has been proposed to dispose a container in the inner housing and place tube racks carrying test tubes in the container. In this case, however, a centrifugal force of the tube rack is applied directly to the container and the centrifugal force is very large, so that the container must be mechanically strong. Accordingly, the container is made of metal and thick and its moment of inertia is large. Also for driving such a container itself, a motor of large power is needed and it is difficult to rapidly accelerate and stop the container.

There has been proposed a centrifuge in which, when the rotor is driven at high speed, air is driven by the rotating rotor to decrease the air pressure in the vicinity of its center of rotation and air is drawn into the centrifuge from an air inlet port formed in its lid in opposing relation to the center of rotation of the rotor, the air drawn through the air inlet port being directed around the rotor to cool it. This arrangement permits easy cooling of the rotor but has the defect that noises are produced in the neighborhood of the air inlet port.

It is an object of the present invention to provide a centrifuge in which test tubes are not subjected to a large air resistance and hence do not greatly rise in temperature nor do they produce noises and which is small in windage loss and consequently permits the use of a motor of small drive power.

Another object of the present invention is to provide a centrifuge in which the rotor is relatively lightweight and hence can be driven by a motor of relatively small power to reduce the overall power consumption.

Still another object is to provide a centrifuge which is adapted to draw air therein to cool the rotor and test tubes, and which is less noisy.

SUMMARY OF THE INVENTION

According to the present invention, the rotor has formed integrally therewith a plurality of arms at equiangular intervals and tube racks are each disposed between adjacent ones of the arms, each of which has stepped portions at its end portion to extend towards the stepped portions of adjacent arms. The upper parts of the arms of the rotor on the side of an open end of an inner housing respectively have formed integrally therewith sectorial plate portions. The sectional plate portions are substantially flush with the upper end faces of the tube racks placed between adjacent arms to form a ring-shaped plane. The rotor is covered with a wind shield, which is cylindrical in shape and bottomed and has its upper end opened. The inner peripheral surface of the wind shield is substantially in contact with the outer peripheral surface of the sectorial plate portions; accordingly, the upper open end of the wind shield is mostly closed by the sectorial plate portions and the tube racks disposed between adjacent arms of the rotor.

Each of the tube racks disposed between adjacent arms of the rotor has made therein a plurality of holes for receiving test tubes and has legs formed integrally therewith at its opposing ends so that the tube rack is substantially U-shaped. The tube rack is placed between adjacent arms of the rotor, with its legs held almost horizontally and with both side marginal portions between the legs abutted against the stepped portions of the arms of the rotor. Accordingly, when the rotor is driven by the motor, a centrifugal force is applied to the tube rack to urge it against the stepped portions. The open end portion of the wind shield is almost closed by one leg of each tube rack and the sectorial plate portions and the other leg of the tube rack is received by the bottom of the wind shield. The tube rack is substantially U-shaped as mentioned above and the length of its legs is selected so that when the tube rack stands, for example, on a table, test tubes inserted into the test tube receiving holes formed between the legs do not reach the table.

As described above, in the centrifuge of the present invention, centrifugal forces applied to the test tubes and the tube racks are received by the stepped portions of the arms of the rotor and the wind shield is attached to the rotor in a manner to surround all the test tubes and, in addition, the open end portion of the wind shield on the side of the open end of the inner housing is almost closed by the sectorial plate portions of the rotor and the upper legs of the tube racks. Accordingly, even when the rotor is driven at high speed, the test tubes are not subjected to air resistance and this is also ensured by the cylindrical wind shield, so that the temperature of the sample in the test tube is not likely to rise and the sample does not change in quality. Moreover, what is called the windage loss is small and the motor may be small in size and in drive power. Since the test tubes are not subjected to air resistance, less noise is produced by the revolving test tubes. The tube racks are received by the rotor and the wind shield does not receive a large centrifugal force applied to the tube racks, so that the wind shield can be made thin and lightweight and hence it is small in inertia. Consequently, it is possible to rapidly rotate the rotor at high speed and stop it quickly. Further, the wind shield is inexpensive in terms of material and manufacture.

The lid of the centrifuge has formed therein an air inlet port. By the rotation of the rotor air is blown off to create a negative pressure in the neighborhood of the center of rotation of the rotor and air is drawn into the centrifuge from the outside through the air inlet port to flow around the rotor to cool it. In this case, the air inlet port is formed to project further to the side of the rotor than the inner surface of the lid and the outer surface of the projecting end portion is tapered so that the radius of the air inlet port decreases towards the rotor. This arrangement reduces or prevents swirling of air which will occur in the vicinity of the air inlet port, to suppress noise generation.

DESCRIPTION OF THE PREFERRED EMBODIMENTS

Figure 1:
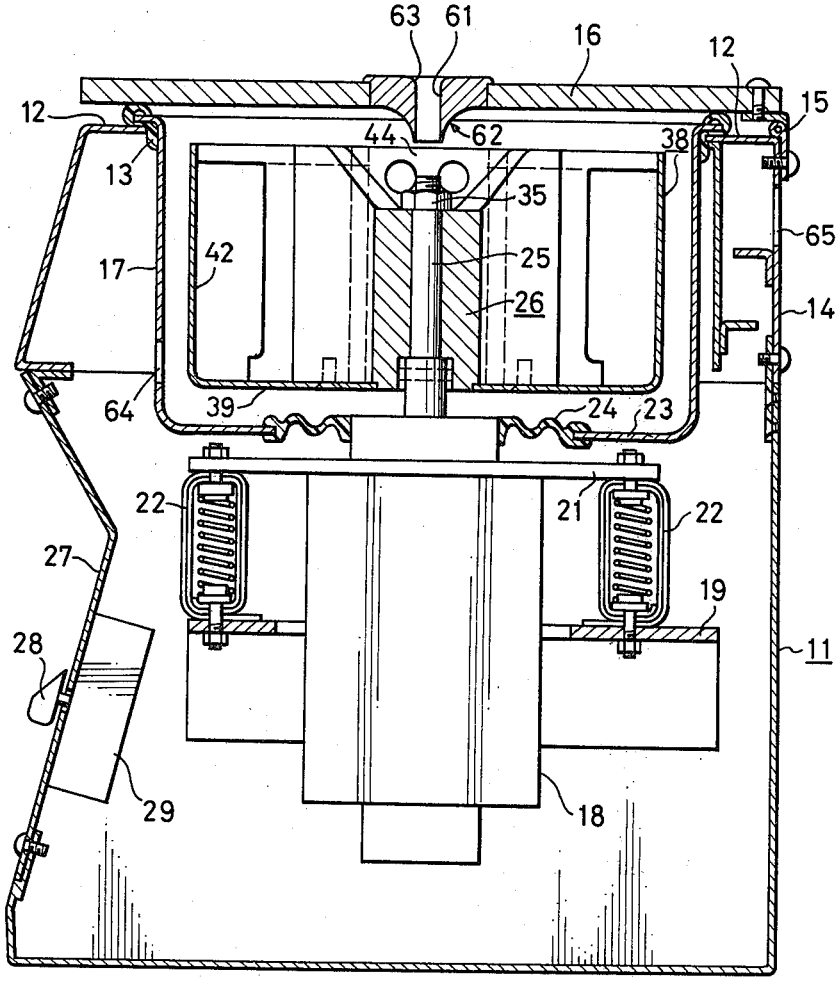
FIG. 1 is a vertical sectional view illustrating an embodiment of a centrifuge of the present invention.

In FIG. 1, an outer housing 11 of the centrifuge has substantially a rectangular configuration and its top panel 12 has formed therein a large opening 13, which is covered with a lid 16 pivotally mounted by a hinge 15 on the top end portion of a rear panel 14 of the outer housing 11. An inner housing 17 is disposed within the outer housing 11 in its upper part and the marginal portion of an upper open end of the inner housing 11 is bent outwardly to form a flange, which is engaged with the top panel 12 so that the inner housing 17 is suspended in the outer housing 11. Disposed under the inner housing 17 in the outer housing 11 is a motor 18. A support plate 19 is fixedly mounted in the outer housing 11 to extend across its intermediate part. The motor 18 is disposed with its intermediate portion lying in a hole made in the support plate 19 and damper means 22 are interposed between the support plate 19 and a flange 21 of the motor 18, by which the motor 18 is supported on the support plate 19. A bottom panel 23 of the inner housing 17 has formed therein a hole, through which the top end portion of the motor 18 extends into the inner housing 17. The space between the marginal edge of the extending portion of the motor 18 and the bottom panel 23 of the inner housing 17 is closed by an elastic closing plate 24, e.g., of rubber. A rotor 26 is mounted on a rotary shaft 25 of the motor 18 in the inner housing 17. A control knob is mounted on a front panel 27 of the outer housing 11 and, by manipulating the knob 28, a control unit 29 mounted on the inside of the panel 27 is activated to control the rotation of the motor 18.

Figure 2:
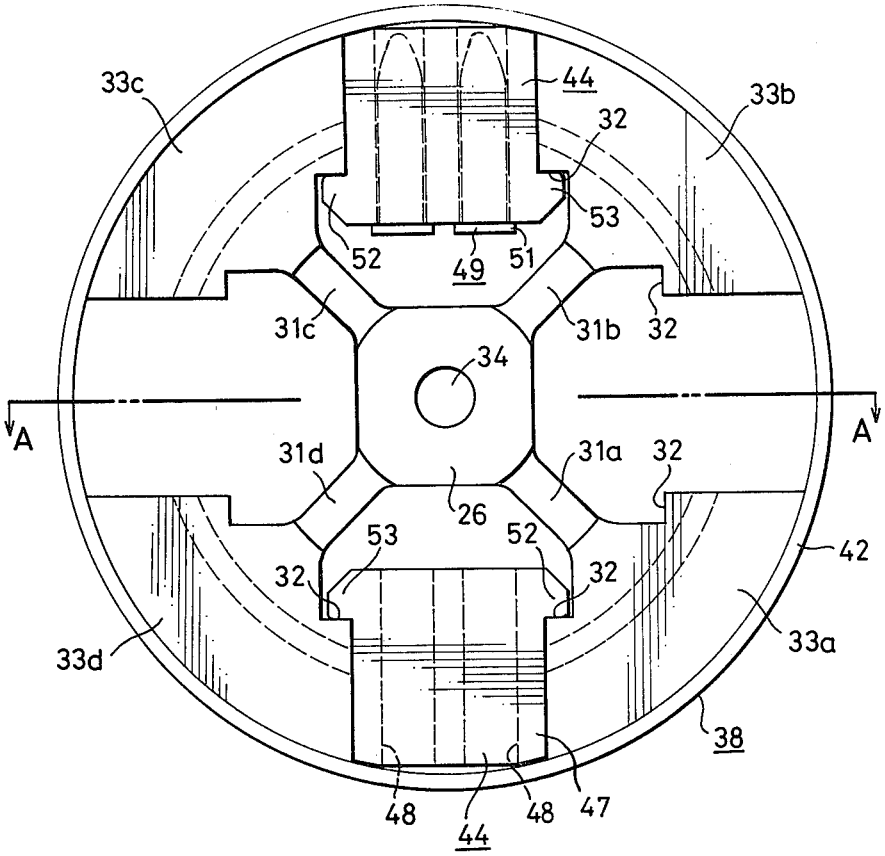
FIG. 2 is a plan view of a rotor used in the embodiment of FIG. 1.
Figure 3:
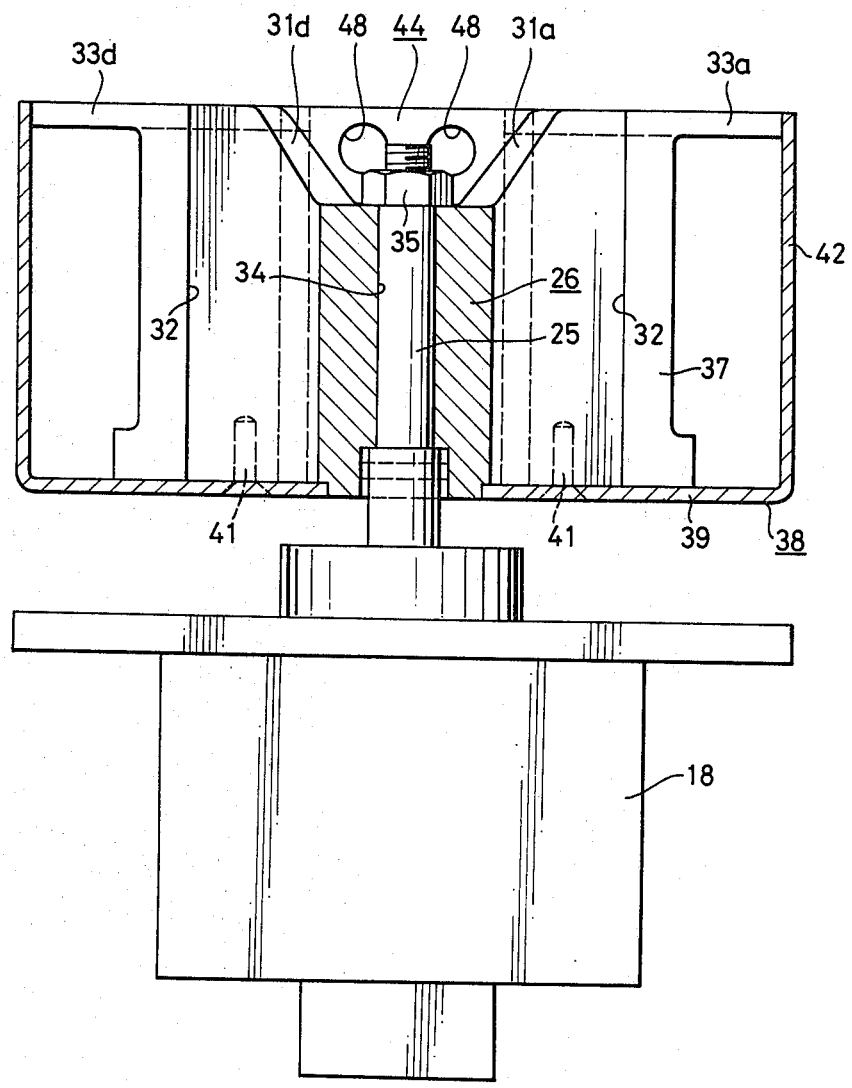
FIG. 3 is a sectional view taken on the line A—A in FIG. 2.
Figure 4:
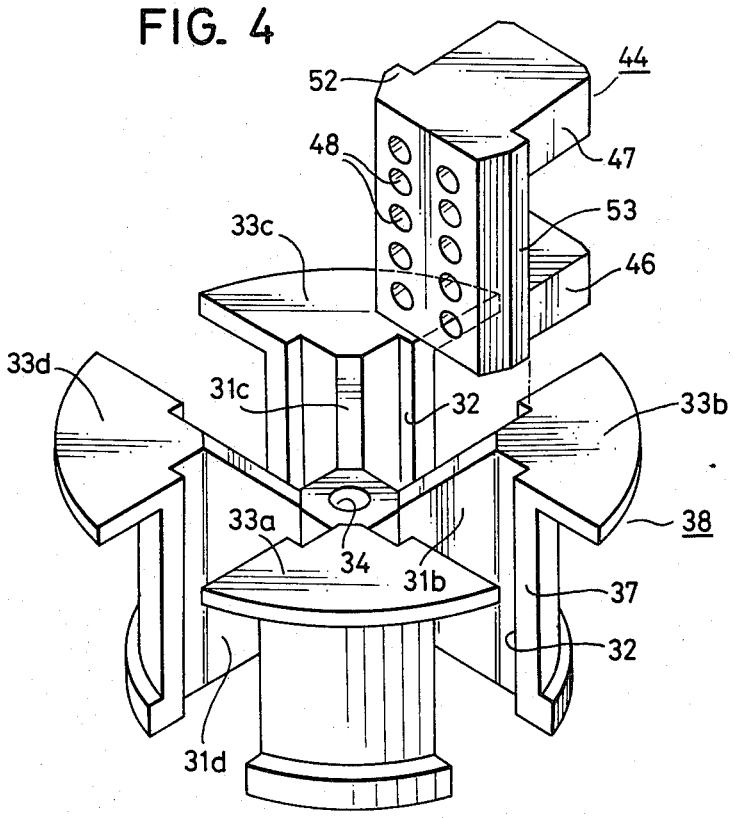
FIG. 4 is a perspective view of the rotor.

As shown in FIGS. 2 to 4, the rotor 26 has formed integrally therewith, for instance, four plate-shaped arms 31*a* to 31*d* at equiangular intervals about its center of rotation. The thickness at the end portion of each arm gradually increases on the both sides of the arm and further projects towards the adjacent arms to form stepped portions 32 on the both sides of the arm, thus providing as a whole a rack receiving portion 37. The upper parts of the arms 31*a* to 31*d* on the side of the open end portion of the inner housing 17 respectively have their ends sectorially expanded as indicated by 33*a* to 33*d*. The arcuate marginal edges of the sectorial plate portions 33*a* to 33*d* lie on the same circle about the center of rotation of the rotor 26. The rotor 26 is tubular-shaped in its central portion and has made therein a through hole 34, into which is inserted the rotary shaft 25 of the motor 18, and a nut 35 is tightened on screw threads cut in the projecting end of the rotary shaft 25, clamping thereto the rotor 26. The nut seating position is lower than the sectorial plate portions 33*a* to 33*d*. The sectorial plate portions 33*a* to 33*d* are formed integrally with the respective rack receiving portions 37 which extends down towards the motor 18. Such a rotor is formed, for example, by machining of a metal or die casting and can be made of aluminum or like material used for the purpose of reducing its weight.

A wind shield 38 is disposed around the rotor 26 in a manner to cover it. The wind shield 38 is cylindrical in shape and its bottom plate 39 is butted against the end faces of the arms 31*a* and 31*d* on the side of the motor 18 and fixed by screws 41 to the arms 31*a* to 31*d*, and is consequently removably attached to the rotor 26. The bottom plate 39 of the wind shield 38 has a centrally disposed opening for receiving the bottom end portion of the tubular body portion of the rotor 26. The open end portion of the wind shield 38 is substantially flush with the sectorial plate portions 33*a* to 33*d* and the upper inner marginal portion of the peripheral wall 42 of the wind shield 38 is held in light contact with the outer peripheral surfaces of the sectorial plate portions 33*a* and 33*d*. The wind shield 38 is produced by press working or drawing of aluminum or the like or as a molding of a synthetic resinous material reinforced by carbon fiber. In this case, the wind shield 38 is required to be as thin as possible but mechanically strong to some extent and lightweight.

Figure 5:
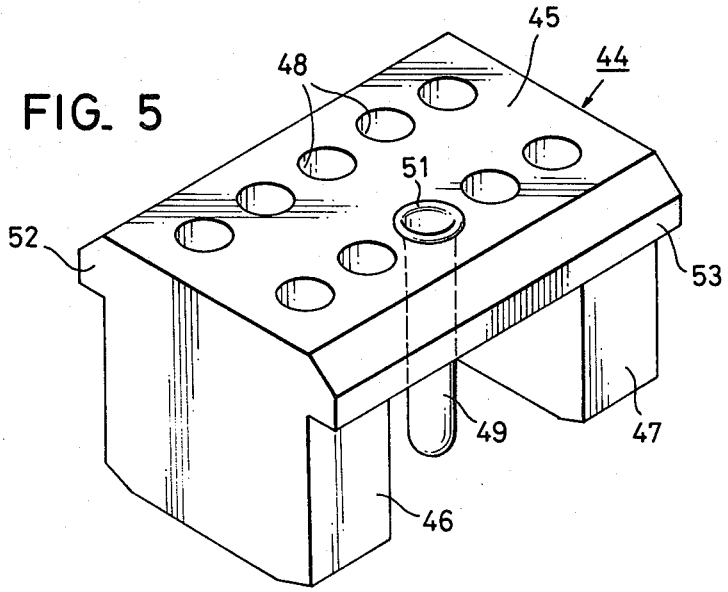
FIG. 5 is a perspective view of a tube rack.

Between adjacent ones of the arms 31*a* to 31*d* of the rotor 26 is disposed a tube rack 44. The tube rack 44 has a substantially U shape such, for example, as shown in FIG. 5 in which a plate-like body 45 has formed integrally therewith legs 46 and 47 extending in the same direction and has made therein one or more rows of tube receiving holes 48. Test tubes 49, each of which has a flange 51 extending outwardly from its open end are respectively inserted into the tube receiving holes 48 and suspended from the body 45 with their flanges 51 rested on the marginal portions of the holes 48. In this case, the test tubes 49 are sufficiently short that when suspended from the body 45, they do not extend to the plane in which the lower end faces of the legs 46 and 47 lie. Both side marginal portions of the body 45 form engaging portions 52 and 53 for engagement with the stepped portions 32 of the rotor arms; namely, the engaging portions 52 and 53 project out perpendicularly to the direction of the legs 46 and 47.

As shown in FIGS. 2 to 4, the tube racks 44 are each inserted between adjacent ones of the arms 31*a* to 31*d* of the rotor 26 in such manner that the outer surface of one of the legs is butted against the bottom plate 39 of the wind shield 38, with the engaging portions 52 and 53 snugly engaged with the stepped portions 32 of adjacent arms, and the upper surface of the other leg is substantially flush with the sectorial plate portions 33*a* to 33*d*, closing the space between the sectorial plate portions of adjacent arms. Accordingly, in this example, when the four tube racks 44 are loaded on the rotor 26, the open end of the wind shield is almost closed by the legs of the tube racks 44 and the sectorial plate portions 33*a* to 33*d*. The tube racks 44 are shaped accordingly. It is preferred that when the tube racks 44 are loaded on the rotor 26, the tube rack bodies 45 are spaced a relatively short distance from the tubular body of the rotor 26. In this example, however, since the nut seating position is lowered as mentioned previously, when the tube racks are loaded, at least one of the sample tubes on each tube rack situates above the upper end face of the tubular body of the rotor, and the tube racks 44 can easily be mounted on and dismounted from the rotor 26. The tube racks 44 can be made by molding, for instance, a synthetic resinous material; and it is preferred to use a synthetic resinous material of relatively large mechanical strength.

Figure 6:
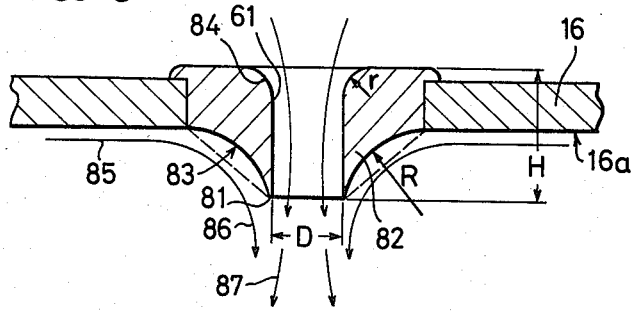
FIG. 6 is an enlarged sectional view illustrating an example of an air inlet port.

The lid 16 has formed therein an air inlet port 61 in alignment with the center of rotation of the rotor 26, as shown in FIG. 1. The air inlet port 61 has a construction such, for instance, as shown in FIG. 6 in which its inner end lies further to the side of the rotor 26 than the inner surface of the lid 16. The outer peripheral surface of the part 82, which defines therein the air inlet port 61 and projects out further to the side of the rotor 26 than the lid 16, slopes upwardly and outwardly as indicated by 83 in such manner that the diameter of the part 82 gradually increases towards the inner surface 16*a* of the lid 16 from the inner end 81. It is preferred that the slope 83 is gently concaved to be of a shape close to the streamline form, permitting a smooth flow of air along the slope 83.

It is desirable that the length H of the air inlet port 61 be 1.2 times or more its inner diameter D. With the length H smaller than 1.2 D, the noise preventing effect is lessened. In contrast, if the length H is too large, then the air inlet port structure is likely to butt against the rotor 26 and the noise preventing effect is saturated and is not so heightened. Accordingly, it is preferred that the length H be smaller than about 4 D.

It is effective that the radius of curvature R of the slope 83 is larger than $\frac{1}{2}$ D, preferably equal to the inner diameter D of the air inlet port 61. Further, the inner peripheral surface of the air inlet port 61 in the vicinity of its outer open end portion also slopes upwardly and outwardly, as indicated by 84 in FIG. 6; namely, the diameter of the air inlet port 61 at its outer open end portion gradually increases towards its outer open end. It is preferred that the radius of curvature r of the slope 84 is larger than $\frac{1}{4}$ D and the effect of providing the slope 84 is obtained when the radius of curvature r is larger than 1/7 D.

In using the centrifuge, the test tubes 49 containing samples are inserted into the test tube receiving holes 48 of the tube racks 44, which are placed in the rotor 26 as shown in FIGS. 2 and 3, and the lid 16 is put on and then the motor 18 is driven to rotate the rotor 26. In this case, air is blown off by the rotation of the rotor 26 to reduce the air pressure in the vicinity of its center of rotation. As a consequence, air is drawn into the inner housing 17 from the outside through the air inlet port 61 to flow along the rotor 26 and then along the wind shield 38 and is blown out into the outer housing 11 through a hole 64 made in the inner housing, thereafter being released to the outside through an exhaust port 65 made in the rear panel 14 of the outer housing 11. In this case, it is possible to absorb noise by providing a zigzag air passage in the neighborhood of the exhaust port 65 in the outer housing 11.

In the centrifuge of the present invention described above, the rotor 26 is formed as a unitary structure with the arms 31*a* to 31*d*, each having the stepped portions 32, and a strong centrifugal force is applied by the rotation of the rotor 26 to the tube racks 44 to urge them into firm engagement with the stepped portions 32. The rotor 26 can be made relatively lightweight and is able to sufficiently support the tube racks 44. In addition, since the rotor structure including the tube racks loaded thereon is surrounded almost entirely by the wind shield 38 and since the upper open end of the wind shield 38 is mostly closed by the tube racks 44 and the sectorial plate portions 33*a* to 33*d*, air in the inner housing is not significantly disturbed and flows smoothly; namely, the air resistance is not large and windage loss is small, and hence the problem of noise generation is not serious.

Figure 7:
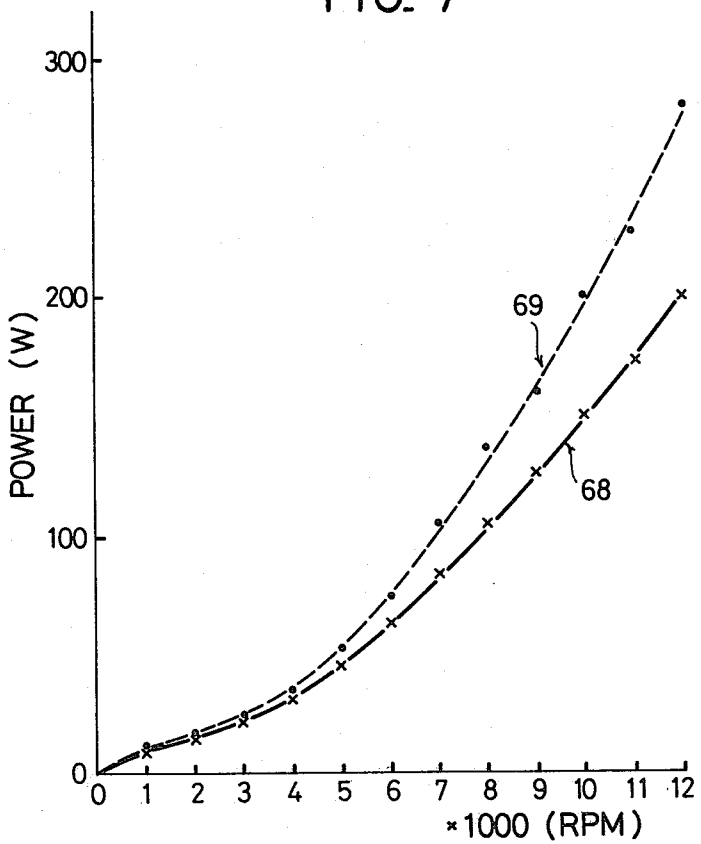
FIG. 7 is a graph showing the relationship between the rotational speed of the rotor and the power consumption of a motor.

The power consumption of the motor 18 relative to variations in the rotational speed of the rotor was measured. The power consumption in the case where the wind shield 38 was used was such as indicated by the curve 68 in FIG. 7, whereas when the wind shield 38 was not used, the power consumption was such as indicated by 69 in FIG. 7. In FIG. 7 the abscissa represents the rotational speed of the rotor and the ordinate the power consumption of the motor. It will be understood that the power consumption varies depending on whether the wind shield 38 is employed or not and that the power consumption can be cut by the provision of the wind shield 38.

Figure 8:
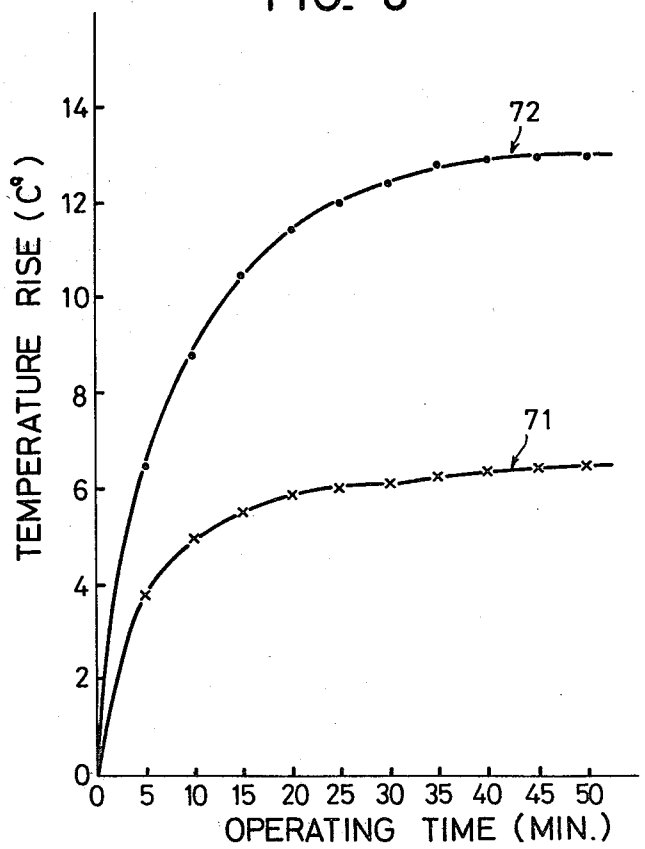
FIG. 8 is a graph showing the relationship between the running time of the centrifuge and the temperature rise of a sample.

In FIG. 8 the abscissa represents the time after starting the rotor and the ordinate a temperature rise of the test tube. The curve 71 indicates the case where the wind shield 38 was used and the curve 72 indicates the case where the wind shield 38 was not provided. In the measurements the revolving speed of the rotor was held at 12,000 R.P.M. A comparison between the curves 71 and 72 shows that the temperature rise differs as much as more than 6° C. depending on whether the wind shield 38 is provided or not. As will be appreciated from the above, with the provision of the wind shield 38, the test tubes meet with little air resistance and hardly generate heat; accordingly, no bad influence is exerted on the samples. Further, noises were measured with the revolving speed of the rotor at 12,000 R.P.M. The noise level was 61.5 phones when the wind shield 38 was provided, but the noise level was 66.8 phones when the wind shield 38 was not used. The filter characteristic of a noise meter used was the A characteristic. Accordingly, the noise generation can also be suppressed by the provision of the wind shield 38.

The provision of the legs 46 and 47 on the tube rack 44 is convenient in that the tube rack 44 carrying the test tubes 49 as shown in FIG. 5 can be stood on a table or bench.

With the air inlet port 61 shown in FIG. 6 in which it projects further to the side of the rotor 26 than the inner surface of the lid 16 and its outer surface forms the slope 83, a current of air 85 flowing along the inner surface of the lid 16 is smoothly directed along the slope 83 to then flow downwardly together with a current of air 87 which is drawn into the air inlet port 61 and released therefrom. Accordingly, there is no fear that the current of air 85 flowing along the inner surface of the lid 16 and the current of air 87 from the air inlet port 61 run against each other to swirl and make noises. Moreover, the sloped outer open end portion 84 of the air inlet port 61 facilitates smooth drawing of air from the outside into the air inlet port 61, ensuring to prevent noise generation.

Figure 9A:
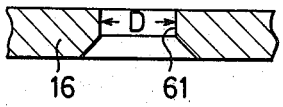
FIGS. 9A to 9E, inclusive, are sectional views showing various examples of air inlet ports.
Figure 9C:
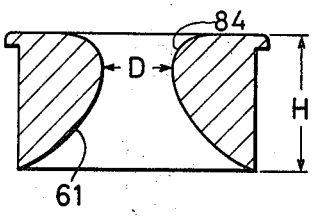
Figure 9B:
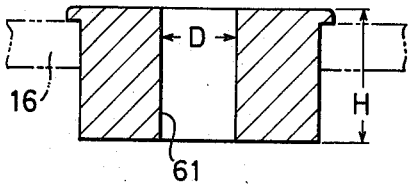
Figure 9D:
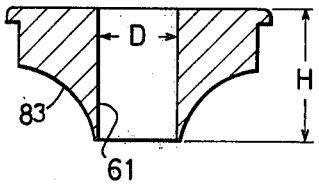

Measurements was made of noises generated by air inlet ports of various designs by the noise meter of the A characteristic in connection with the case where the same rotor was driven at 12,000 R.P.M. In the case where the air inlet port 61 had a shape as shown in FIG. 9A and 13 mm in inner diameter D and the lid 16 was 8 mm thick, the noise level was 87.5 phones. In the case where the air inlet port 61 had a shape as shown in FIG. 9B and 13 mm in inner diameter D, 22 mm in length H and 40 mm in outer diameter, the noise level was 86.5 phones. In the case where the air inlet port had a shape as shown in FIG. 9C and 22 mm in length H, 13 mm in inner diameter, 5 mm in the radius of curvature of the slope 84 at the upper end, 18 mm in the radius of curvature of the lower end and 40 mm in outer diameter, the noise level was 86.5 phones. In the case where the air inlet port had a construction as shown in FIG. 9D in which the inner diameter D, the length H and the outer diameter were 13 mm, 22 mm and 40 mm respectively, the slope 84 was not formed at the upper end and the slope 83 was formed with a radius of curvature of 15 mm, the noise level was 84.5 phones. This is lower than the noise levels in the above three examples; especially, it is reduced more than 3 phones, as compared with the case of the conventional air inlet port structure of FIG. 9A.

In the case of the air inlet port shown in FIG. 6, when its length H, outer diameter and inner diameter were 22 mm, 40 mm and 13 mm respectively and the radii of curvature of the slopes 83 and 84 were 15 mm and 10 mm respectively, the noise level was 82.8 phones. In the case of an air inlet port of the same shape and size as above except that the radius of curvature of the slope 84 was 5 mm, the noise level was further reduced to 82.2 phones. With the air inlet port structure shown in FIG. 6, the noise level can be lowered more than 6 phones, as compared with the prior art structure of FIG. 9A. Generally it is very difficult to lower the noise level as much as 6 phones, but this can be accomplished by the air inlet port 61 shown in FIG. 6.

The air inlet port of FIG. 6 exhibits the noise preventing effect regardless of the revolving speed of the rotor. In the case where the air inlet port 61 of FIG. 6 was 13 mm in inner diameter, 40 mm in outer diameter, 22 mm in length H, 15 mm in the radius of curvature of the slope 83 and 5 mm in the radius of curvature of the slope 84 and the revolving speed of the rotor was 12,000 R.P.M., there was obtained such a noise frequency characteristic as indicated by the curve 91 in FIG. 10. When the revolving speed of the rotor was reduced to 10,000 R.P.M., the noise frequency characteristic was such as indicated by the curve 92; and when the revolving speed of the rotor was further decreased to 8,000 R.P.M., the characteristic was such as indicated by the curve 93. The noise naturally becomes low as the revolving speed is decreased and these curves show the same tendency. This indicates that the air inlet port structure shown in FIG. 6 is effective to abate the noise regardless of the revolving speed of the rotor.

Figure 10:
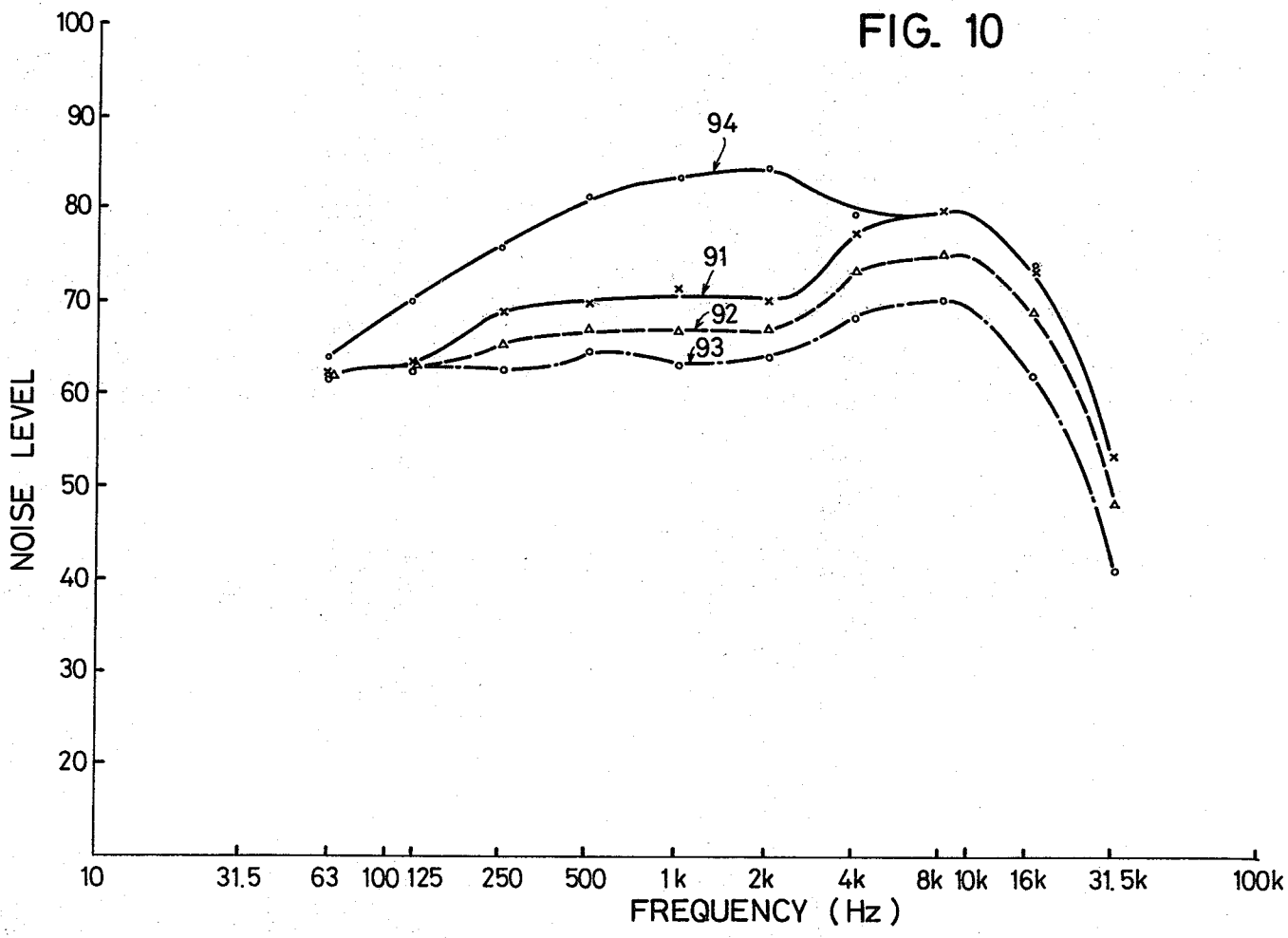
FIG. 10 is a graph showing the frequency characteristics of noises generated by air inlet ports.

When the diameter of the air inlet port shown in FIG. 9A was 13 mm, the noise frequency characteristic was such as indicated by the curve 94 in FIG. 10. A comparison of the curve 94 with the curves 91 to 93 shows that the air inlet port structure of FIG. 6 is less noisy. In addition, it will also be appreciated that the most harsh noises of 1 KHz, 2 KHz or lower frequencies are abated.

Figure 9E:
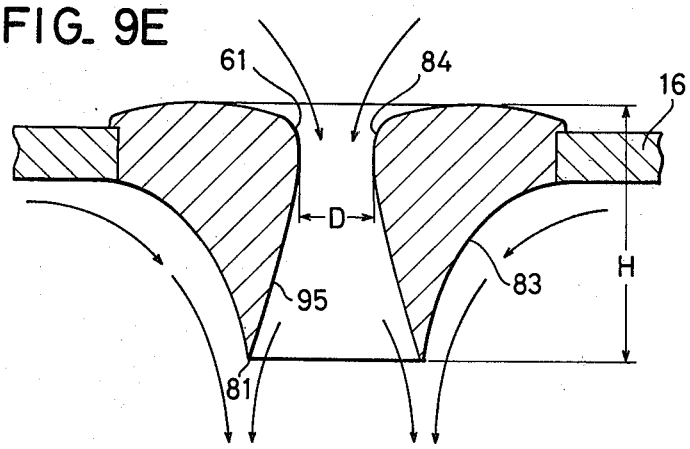

It is also possible to employ an air inlet port structure as shown in FIG. 9E in which the inner peripheral surface of the inner end portion of the port also forms a slope 95 so that the inner diameter gradually increases towards the lower open end on the side of the rotor. This air inlet port structure further suppresses noise generation. As is evident from the example shown in FIG. 9B, noise can be abated even if the slope 84 is not formed. It is desirable that the slope 83 be of streamline shape, but the slope 83 need not always be a concave curved slope and may also be straight as indicated by the broken lines in FIG. 6. In the cases of FIGS. 6, 9D and 9E, the air inlet port structure is produced separately of the lid 16 and fitted into a hole made in the lid 16. Such an air inlet port structure can be made of aluminum, brass or like metal, or synthetic resin, rubber or the like. In the case of making the air inlet structure by molding, even if the slopes are complex in shape, once one mold is produced accurately the air inlet structure can be mass-produced at low cost. The air inlet port structure can be pressed into the lid 16 or attached thereto by an adhesive binder. It is preferred that the air inlet port structure be made of a material whose surface is smooth so as not to disturb the current of air flowing thereon. The air inlet port structure need not always be formed separately of the lid but may also be formed as a unitary structure with the lid. Furthermore, the use of the present invention is not limited specifically to the rotor shown in FIG. 1, i.e., the invention is generally applicable to arrangements for cooling rotors and test tubes.

It will be apparent that many modifications and variations may be effected without departing from the scope of novel concepts of this invention.

What is claimed is:

1. A centrifuge comprising:

an outer housing having an opening in its top panel;

an inner housing disposed in the outer housing, the upper end portion of said inner housing being engaged with the marginal portion of the opening of the outer housing;

a lid for covering the opening of the outer housing;

a motor disposed below the inner housing in the outer housing, said motor having a rotary shaft which extends into said inner housing;

a rotor disposed in the inner housing and mounted on the portion of the rotary shaft of the motor which extends into the inner housing, the rotor having formed integrally therewith a plurality of arms disposed at equiangular intervals about its center of rotation, the arms each having stepped portions formed therein at its end to extend towards adjacent arms, and the upper parts of the arms on the side of the opening of the outer housing being respectively expanded sectorially to form sectorial plate portions having arcuate marginal edges;

a bottomed, cylindrical wind shield disposed to surround the rotor, the upper marginal portion of the inner surface of the wind shield being held in contact with the arcuate marginal edges of the sectorial plate portions;

tube racks inserted between adjacent ones of the arms of the rotor to hold test tubes substantially at right angles to the rotary shaft, each tube rack having forming integrally therewith engaging portions for engagement with the stepped portions of each arm so that a centrifugal force applied to the tube rack is received by the stepped portions, the tube racks having end faces so shaped that, when said tube racks are loaded on the rotor, said end faces on the side of the open end of the wind shield cooperate with the sectorial plate portions of the rotor to almost entirely close the open end of the wind shield.

2. A centrifuge according to claim 1 wherein the tube racks are each formed to have a rack body having made therein a plurality of test tube receiving holes, legs formed as a unitary structure with the rack body at both end portions thereof and the engaging portions formed integrally with the rack body on both sides thereof, the lengths of the legs being selected such that when test tubes are loaded in the test tube receiving holes, the projecting ends of the test tubes do not reach the plane in which the end faces of the legs lie.

3. A centrifuge according to claim 1 wherein the bottom panel of the wind shield is removably attached to the rotor.

4. A centrifuge according to claim 1 wherein each of the arms is a plate-like arm lying on the plane including the rotation axis of the rotor; the upper part of the plate-like arm is coupled with the bottom of the sectorial plate portion to form a unitary structure; and the bottom of the plate-like arm is butted against the bottom panel of the wind shield.

5. A centrifuge according to any one of claims 1 to 4 wherein the central portion of the rotor is tubular in shape; the rotary shaft of the motor is inserted into the tubular portion; the projecting end portion of the rotary shaft is clamped by clamping means to fix the rotor to the rotary shaft; and the top end face of the tubular portion lies below the sectorial plate portions to form a recess at the top end face of the rotor for receiving the clamping means.

6. A centrifuge according to claim 5 wherein at least one of the test tube receiving holes of each tube rack is situated above the bottom of the recess when the tube rack is loaded on the rotor.

7. A centrifuge comprising:

an outer housing having a top panel which defines an opening;

an inner housing disposed in the outer housing, the upper end portion of said inner housing being engaged with the marginal portion of said opening;

a motor disposed below the inner housing in the outer housing, said motor including a rotary shaft which extends into said inner housing;

a rotor disposed in the inner housing and mounted on the portion of the rotary shaft of the motor inserted into the inner housing;

a lid for covering the opening of the outer housing; and an air inlet port formed in the lid substantially in alignment with the center of rotation of the rotor for drawing air from the outside into the inner housing when the air pressure therein in the vicinity of the center of rotation of the rotor is lowered by the rotation of the rotor, the air inlet port projecting out closer to the side of the rotor than the inner surface of the lid and the outer peripheral surface of the projecting end portion being tapered so that its diameter gradually decreases towards the rotor from the inner surface of the lid.

8. A centrifuge according to claim 7 wherein, the length 4 and the inner diameter D of the air inlet port are such that the length H is in the range of 1.2 D to 4 D.

9. A centrifuge according to claim 7 wherein the slope of the projecting end portion of the air inlet port has a gently concaved streamline shape.

10. A centrifuge according to claim 9 wherein the radius of curvature R of the slope of the projecting end portion of the air inlet port is larger than one-half of the inner diameter D of the air inlet port.

11. A centrifuge according to claim 10 wherein the radius of curvature R of the slope of the projecting end portion of the air inlet port is substantially equal to the inner diameter D of the air inlet port.

12. A centrifuge according to any one of claims 7 to 11 wherein the inner surface of the outer open end portion of the air inlet port is formed to slope upwardly and outwardly so that the inner diameter D of the air inlet port gradually increases towards the upper open end of the air inlet port.

13. A centrifuge according to claim 12 wherein the curvature of radius r of the slope on the side of the outer open end portion of the air inlet port is larger than D/7.

14. A centrifuge according to claim 13 wherein the radius of curvature r is larger than D/4.

* * * * *